US005118302A

United States Patent [19]

Fussell et al.

[11] Patent Number: 5,118,302

[45] Date of Patent: Jun. 2, 1992

[54] ELECTRICAL CONNECTOR

[75] Inventors: David A. Fussell, Stone Mountain; David Morrison, Atlanta, both of Ga.

[73] Assignee: Ornamotor, Inc., Stone Mountain, Ga.

[21] Appl. No.: 709,271

[22] Filed: Jun. 3, 1991

[51] Int. Cl.[5] ..... H01R 33/02; H01R 13/02

[52] U.S. Cl. ..... 439/225; 439/240

[58] Field of Search ..... 439/225, 232, 236, 239-241

[56] References Cited

U.S. PATENT DOCUMENTS 3,401,242 9/1968 McLaughlin ..... 439/240

3,989,335 11/1976 Belokin, Jr. ..... 439/225

4,218,106 8/1980 Belokin, Jr. ..... 439/225

*Primary Examiner*—Paula A. Bradley

*Attorney, Agent, or Firm*—James A. Hinkle

[57] ABSTRACT

An electrical connector designed to fit about the contact pins of a fluorescent lamp and to supply electric power to a small electric motor of animated display purposes. The connector is of thin elongated construction having one end thereof which is bifurcated to allow the connector to be placed about the lamp contact pins. Electrodes contained within the bifurcated portion contact the lamp pins and supply power to the motor.

9 Claims, 2 Drawing Sheets 11
26
28
20
29
31a
27
33
35
36
31b
32
34
25
22
23
39

37

ELECTRICAL CONNECTOR

BACKGROUND OF THE INVENTION

I. Field of the Invention

The present invention relates generally to electrical connectors and, more particularly, to an electrical connector which is designed to be utilized with a fluorescent lamp and its associated lamp fixture where electrical power is taken from the pins of the fluorescent lamp and supplied to a small electrical motor for the purpose of providing an animated display to be hung from various locations in commercial establishments.

II. Description of the Prior Art

Signage in commercial establishments is certainly well known, however such signage is typically of a fixed variety either mounted on a pole or suspended from the ceiling on a cord which allows the signage to be fully rotatable without external forces. However, it has been found that such signage is much more effective when the signage is given motion to attract the eye of the buyer.

In the past there have been various means for effecting motion on display signage, however, the prior art devices comprise extremely cumbersome motors or motion generating devices and typically such have been utilized only with relatively high standard electrical voltage. It has been found that the prior art devices are quite lacking in their ease of use and in the ability to utilize the devices in various locations due to the bulk and size of the devices.

SUMMARY OF THE INVENTION

In accordance with the present invention it is contemplated that an electrical connector will be provided wherein the connector may be mounted in a fluorescent fixture between the fluorescent lamp and the lamp socket in order to receive electrical current therefrom to supply a small electrical motor which will act as a motive force to provide animation to display apparatus.

It is, therefore, an object of the invention to provide a novel and unique electrical connecting apparatus which will fit around the dual pins of a fluorescent lamp to receive low voltage energization therefrom which is then supplied to a low voltage electrical motor used in a commercial environment for animated display purposes.

Another object of the invention is the provision of a unique electrical connector designed to be used in conjunction with a fluorescent lamp, and its associated lamp socket, to draw power therefrom to provide energization to other devices.

Yet another object of the invention is the provision of an easily manufactured, relatively inexpensive, electrical connector which is readily adapted to a commercial environment to provide a power source for animated displays.

Other objects, advantages and capabilities of the invention will become apparent from the following description taken in conjunction with the accompanying drawings, showing only a preferred embodiment of the invention.

DESCRIPTION OF THE PREFERRED EMBODIMENT

Figure 1:
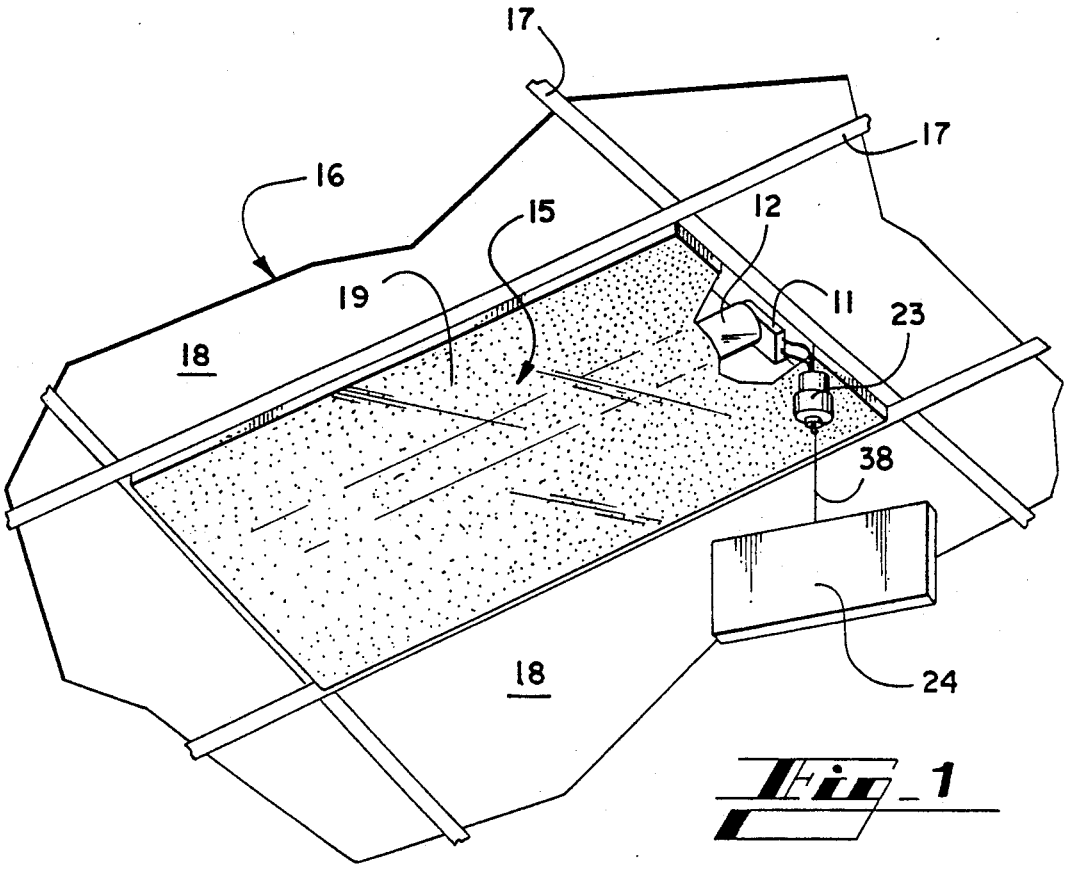
FIG. 1 is an overall perspective view of a fluorescent fixture mounted in a ceiling grid system showing the invention attached to the fluorescent lamp.
Figure 5:
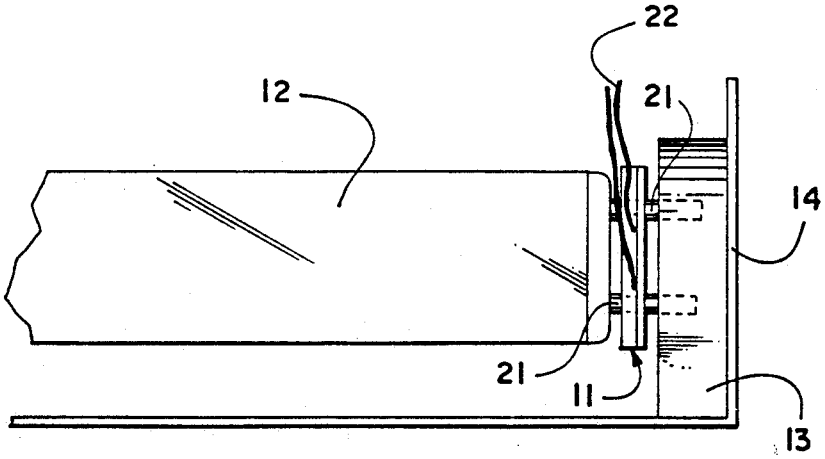
FIG. 5 is a partial section elevation view showing a fluorescent lamp and its associated lamp socket with the invention attached in its normal operative position.

Referring to the drawings wherein like reference numerals designate corresponding parts throughout the several figures, the electrical connector of the present invention is shown by the numeral 11. Inasmuch as the connector is designed to be utilized in its primary mode in the commercial display field, it is shown in FIG. 1 being connected to a fluorescent lamp 12 which is mounted in a lamp socket 13 of frame 14, which frame comprises a portion of the fluorescent fixture 15. In the typical environment, the fluorescent fixture 15 would normally be mounted in a drop ceiling arrangement 16 comprising supporting grids 17, ceiling tiles 18 and a diffuser panel 19.

In its intended mode the connector 11 fits about lamp pins 21 of the lamp 12, which pins make electrical contact within the lamp socket 13 to supply low voltage electrical energy to the fluorescent lamp 12 to cause the lamp to become illuminated. By means to be described, the connector 11 supplies electrical energy through electrical leads 22 to a small low voltage electric motor 23 which in turn is capable of causing a display sign 24 to have animation to attract attention of customers.

The connector plate 20 generally comprises an elongated relatively thin connector which has a proximal end 25, a distal end 26 and opposing sides 27. The distal end of the connector is bifurcated thereby forming an access slot 28 projecting into the interior of the connector plate and terminating in the central portion thereof in an enlarged circular opening 29.

Electrical contact means are provided within the grooves of the connector plate and are shown as lamp contact electrodes 31 which are so positioned that the individual electrodes, indicated by numerals **31*a* and 31*b*, are positioned in a flanking relationship with respect to the enlarged opening 29. As is more definitively shown in FIGS. 2 and 3, the exposed electrodes are then able to fit about the lamp pins 21 when the connector is placed in operative position. In order to position the connector properly, the pair of lamp pins 21 would slide into the access slot 28 and then the person installing the connector would rotate the connector in a 90 degree arc thereby positioning the lamp pin contact electrodes 31*a* and 31*b* with respective lamp pins 21 to complete the electrical circuit. As is readily seen in FIG. 3, the electrical motor 23 is connected to the leads 22 and ultimately to electrodes 31*a* and 31*b* at the connecting point 32 within the connector plate 20**.

Figures 2, 3, 4:
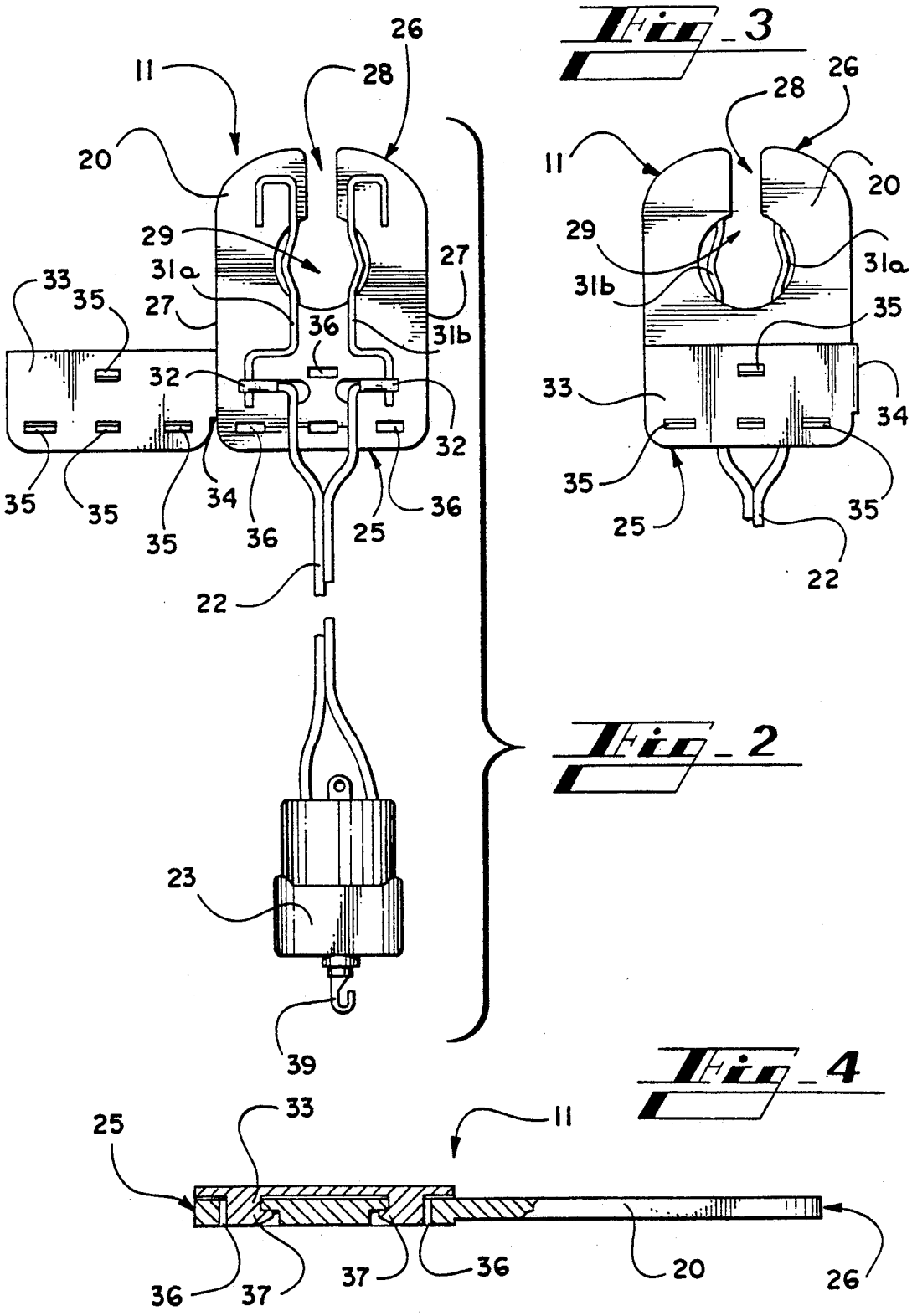
FIG. 2 is a front elevation view of the invention showing an electric motor attached thereto.
FIG. 3 is a rear elevation view of the invention similar to that shown in FIG. 2 without the associated motor.
FIG. 4 is a partial section view showing details of the lower portion of the invention.

As is evident from the showing in FIG. 3, the electrodes **31*a*, 31*b* and the lead connection points 32 are accessible to the exterior of the connector plate and, therefore, there is provided a closure panel 33 which is pivotally connected to one of the opposing sides 27 of the connector plate 20 so that the closure panel 33 may swing about the pivot, or hinge, 34 and close upon the connector plate 11 to cover the portions of the electrodes and other electrical connections which would be accessible to a user once the connector is in place. This, of course, will prevent the possibility of electrical shock. To permit the closure panel to be closed upon and to be maintained in juxtaposition with the electrical connector plate 20, the closure plate will be provided with a series of closure clips 35 projecting substantially perpendicularly from the closure panel to interact in a locking engagement with closure receiving slots 36 of the connector plate. As is more readily seen in FIG. 4, the closure clips 35 have an L-shaped configuration so that the short leg 37 of the clip 35 snaps around the edge of the receiving slot 36, and in this fashion the closure panel is maintained in a locked manner to the electrical connector plate 11. Of course, the closure clips 35 and the receiving slots 36 could well be reversed with the receiving slots being in closure panel 33 and the closure clips 35 being in the connector plate 20**, and the intended purpose would still be achieved.

In operation the user would, as alluded to earlier, slip the connector over the lamp pins 21 to place the lamp pins into the access slot 28 and down into the enlarged opening 29, at which time the user would then pivot the connector plate 20 in a 90 degree arc thereby engaging lamp pins 21 with respective electrodes 31*a*, 31*b*. Inasmuch as a fluorescent fixture is essentially a low voltage light the low voltage supplied to a lamp would, at this point, be supplied to motor 23 which, by means of the hanger support 38 attached to the hanger hook 39, would rotate the sign or other advertising indicia member 24. Of course, if it is desired to achieve animated displays other than a sign, the same set-up could be utilized and the motor 23 is sufficiently versatile to achieve any numbers of animated displays.

Various modifications may be made of the invention without departing from the scope thereof and it is desired, therefore, that only such limitations shall be placed thereon as are imposed by the prior art and which are set forth in the appended claims.

What is claimed is:

1. An electrical connector for use in conjunction with a fluorescent tube affixed in operative relationship with a fluorescent tube lamp holder, the fluorescent tube and the fluorescent tube lamp holder when affixed in operative relationship having a defined space between the fluorescent tube and the fluorescent tube lamp holder, the electrical connector comprising:

an elongated thin connector plate having a proximal end and a distal end and opposing sides, the connector plate being of a size permitting the connector plate to fit in the defined space between the fluorescent tube and the fluorescent tube lamp holder, the distal end of the plate being bifurcated forming an access slot projecting into the interior of the plate, the access slot terminating in an enlarged opening, electrical contact means positioned within the connector plate, the electrical contact means comprising a pair of resilient electrodes positioned within the connector plate in a flanking relationship with respect to the access slot, the electrodes being mounted within the connector plate to project into the enlarged opening of the access slot.

2. An electrical connector as claimed in claim 1, wherein the closure panel is pivotally connected to one of the opposing sides of the connector plate.

3. An electrical connector as claimed in claim 2, wherein locking means are provided to maintain the closure panel fixed to the connector plate.

4. An electrical connector as claimed in claim 3, wherein the locking means maintains the closure panel in juxtaposition with the proximal end of the connector plate.

5. An electrical connector as claimed in claim 4, wherein the locking means further comprises at least one cooperative interlocking member positioned on both the connector plate and the closure panel for mutual engagement to lock the closure panel to the connector plate.

6. An electrical connector as claimed in claim 5, wherein the locking means comprise at least one substantially L-shaped locking clip projecting from the closure panel and engaging a receiving slot in the connector plate to lock the closure panel to the connecting plate.

7. An electrical connector as claimed in claim 6, having an electrical line cord connected to the contact means and projecting exteriorly of the connector, motor means connected to the line cord.

8. An electrical connector as claimed in claim 5, wherein the locking means comprise at least one substantially L-shaped locking clip projecting from the connector plate and engaging a receiving slot in the closure panel to lock the connecting plate to the closure panel.

9. An electrical connector as claimed in claim 8, having an electrical line cord connected to the contact means and projecting exteriorly of the connector, motor means connected to the line cord.

* * * * *